United States Patent [19]

Capeling et al.

[11] 4,046,090

[45] Sept. 6, 1977

[54] APPARATUS AND METHOD FOR MAKING DECORATIVE TILES

[76] Inventors: Thomas W. Capeling, 1295 N. Wayne Road; Robert G. Lovins, 470 Hickory Lane, both of Westland, Mich. 48185

[21] Appl. No.: 704,587

[22] Filed: July 12, 1976

[51] Int. Cl.[2] ..... B21D 53/44; B21D 19/00

[52] U.S. Cl. ..... 113/1 K; 113/116 Z; 113/120 BB; 72/322; 29/403

[58] Field of Search ..... 72/296, 316, 319, 320, 72/322, 379, 388, 459, 460, 476, 479, 381; 113/116 Z, 116 V, 120 G, 116 R, 120 M, 120 BB, 120 R, 1 K; 29/403; 269/87, 90, 126, 127, 129, 134, 189, 237, 238, 246, 91

[56] References Cited

U.S. PATENT DOCUMENTS

| | | | |
|---|---|---|---|
| 1,536,310 | 5/1925 | Rothlisberger | 269/91 |
| 2,149,882 | 3/1939 | Clements | 72/379 |
| 2,195,537 | 4/1940 | Leskiewicz | 269/238 |
| 3,020,590 | 2/1962 | Siegert | 72/322 |
| 3,416,217 | 12/1968 | Walker | 113/116 R |
| 3,786,666 | 1/1974 | York | 72/305 |

*Primary Examiner*—Michael J. Keenan
*Attorney, Agent, or Firm*—Reising, Ethington, Barnard

[57] ABSTRACT

Apparatus and a method for making decorative tiles from container cans wherein a pair of clamp members have generally rectangular clamping surfaces between which a flattened can portion of a rectangular shape is clamped with at least one of its edges projecting outwardly from between the clamp members. One of the clamp members, which is preferably a base clamp member on which the other clamp member is movably supported, has an edge surface that extends from its clamping surface in a perpendicular relationship adjacent the outwardly projecting can portion edge. The other movably supported clamp member has an edge surface that is inclined with respect to its clamping surface adjacent the outwardly projecting can portion edge so that this edge can be readily bent toward the perpendicular edge surface of the base clamp member to provide a reinforcing edge flange. Preferably, the clamp members have three sets of the perpendicular and inclined edge surfaces so that all but one edge of the can portion can be provided with the reinforcing flanges during a single clamping of the can portion. The remaining edge is bent during another clamping to complete the tile fabrication. A screw and nut arrangement is utilized to maintain the clamp members in a closed position clamping the can portion. A template of the apparatus is preferably utilized in cutting the can portion to the proper size and a manual tool with a curved work portion is preferably utilized to bend the can portion edges.

8 Claims, 8 Drawing Figures

APPARATUS AND METHOD FOR MAKING DECORATIVE TILES

BACKGROUND OF THE INVENTION

1. Field of the Invention

This invention relates to apparatus and a method for making decorative tiles from container cans such as beer cans, soft drink cans, or other cans having decorative markings applied to their exterior surface.

2. Description of the Prior Art

Many container cans such as beer cans, soft drink cans, and other food cans etc. have decorative markings printed on their outer surface so as to have an aesthetically appealing appearance that attracts shoppers in stores within which the cans are displayed. One construction of such ans uses tin coated steel that is formed in a round cylindrical shape and welded to provide a side seam extending between opposite ends of the can where end portions are crimped over to provide end seams. Another construction of these cans utilizes an extruded aluminum cup whose upper end is closed by an end portion that is crimped to provide an end seam in the same manner utilized at both ends with the tin coated steel type of can. While the aluminum type of can is much softer and bendable than the steel type, both of these cans provide functional containers for beverages and food etc. The decorative markings applied to both of these types of cans are printed onto their outer surface to provide the aesthetically appealing can appearance. Certain cans are also provided with embossed printing to further enhance their appearance.

Decorative tiles having an aesthetically appealing appearance are utilized in homes and offices etc. in order to decorate walls, provide coasters, or enhance the appearance of manufactured articles. Usually these tiles are made from ceramic material and are painted to provide their decorative appearance prior to being baked so that the decorative markings become permanent. However, wood has also been utilized with decals over which numerous layers of varnish are applied so as to likewise provide a tile with a decorative appearance.

SUMMARY OF THE INVENTION

An object of the present invention is to provide apparatus and a method for fabricating decorative tiles from container cans such as beer cans and soft drink cans, etc.

In carrying the above object, a pair of clamp members with generally rectangular clamping surfaces are utilized to clamp a flattened can portion therebetween with at least one edge of the can portion projecting outwardly from between the clamp members. One of the clamp members, which is preferably a base clamp member on which the other clamp member is movably supported, has an edge surface that extends from its clamping surface adjacent the outwardly projecting can portion edge in a perpendicular relationship. The other movably supported clamp member has an edge surface that extends from its clamping surface adjacent the outwardly projecting can portion edge in an inclined relationship. Bending of the outwardly projecting can portion edge can readily be accomplished due to the open space provided adjacent the can portion edge by the inclined edge surface of the movable clamp member. This bending proceeds in a direction away from the inclined edge surface toward and into engagement with the perpendicular edge surface on the base clamp member in order to provide a reinforcing edge flange to the can portion. A manual tool preferably with a curved work portion is used to bend the can portion edge when it is made from relatively rigid tin coated steel. Bending may also be accomplished by pressing the can portion edge against a flat surface such as a table surface when the can portion is made from aluminum and is relatively pliable.

In the preferred embodiment of the apparatus disclosed, the base clamp member has upwardly projecting mounting portions between which a projection of the movable clamp member is received and pivotally supported by a pin. The movable clamp member pivots between an open position where can portions can be inserted between the clamping surfaces and removed after being bent and a closed position where the clamping surfaces engage a can portion therebetween in a clamped relationship. A nut mounted on the base clamp member and a screw on the movable clamp member are utilized to secure the clamp members in their closed position clamping a can portion. A slot in the base clamp member receives an end of the screw during movement of the movable clamp member to the closed position so as to facilitate threading of the screw end into the nut.

Three sets of the inclined and perpendicular edge surfaces are preferably provided on the clamp members so that three flanges can be bent on the can portion with a single positioning of the clamp members in their closed position. Subsequently, another clamping of the can portion with its unbent edge projecting outwardly adjacent a set of inclined and perpendicular edge surfaces permits the fourth flange of the can portion to be bent in order to complete the fabrication of the decorative tile. A flat foam attachment member with adhesive on its opposite sides is applied to the tile on its back side toward which the bent reinforcing flanges project in order to provide for mounting with its front side exposed.

The apparatus also includes a template having a square opening used to trace the configuration of the can portion used in fabricating the tile. After tracing this configuration, the can portion is cut with a tin snips or scissors. Corner markings of the template are utilized to provide for cutting off the corners of the can portion so that the edges thereof can be bent to form the flanges without any excess corner material that would inhibit the bending.

The objects, features and advantages of the present invention are readily apparent from the following detailed description of the preferred embodiment and the accompanying drawing.

DETAILED DESCRIPTION OF THE PREFERRED EMBODIMENT

Figure 1:
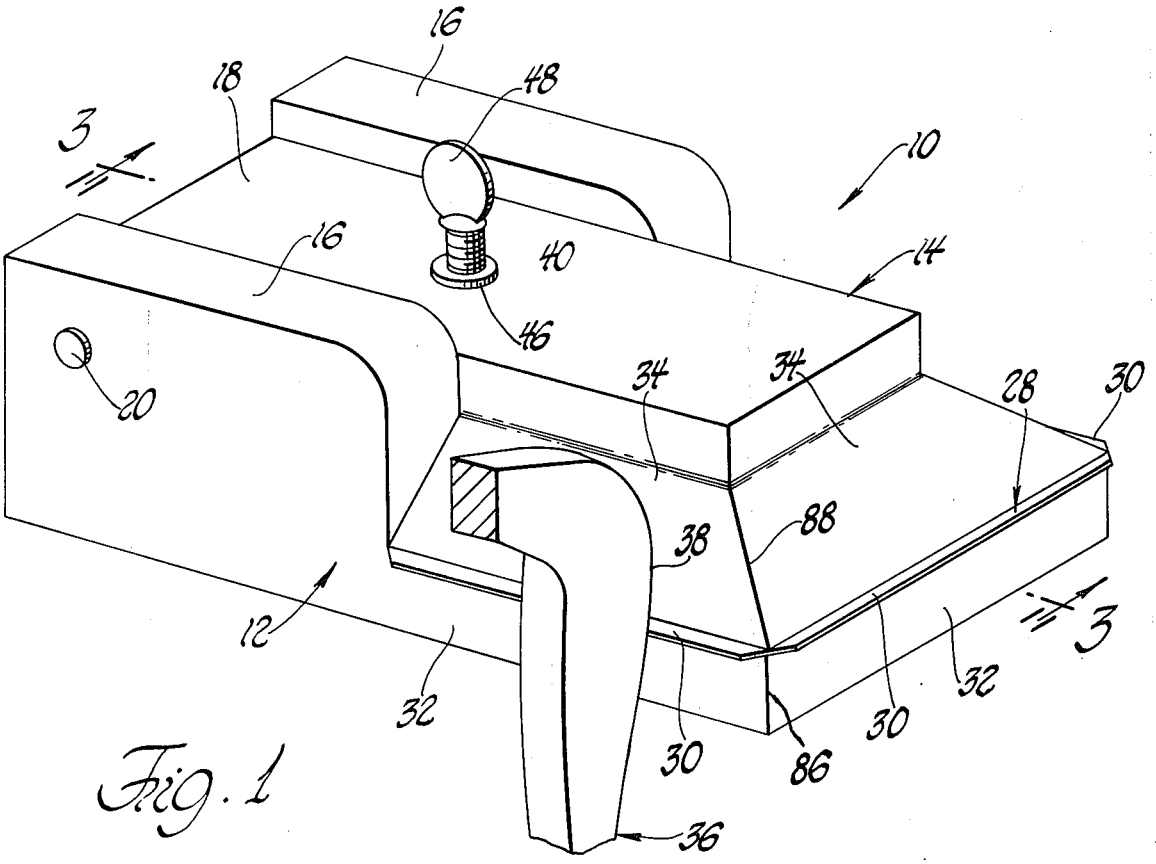
FIG. 1 is a perspective view of apparatus constructed according to this invention and used in accordance with the method thereof to fabricate decorative tiles, the apparatus including two clamp members that are shown in a closed position clamping a can portion from which the tile is fabricated.
Figure 2:
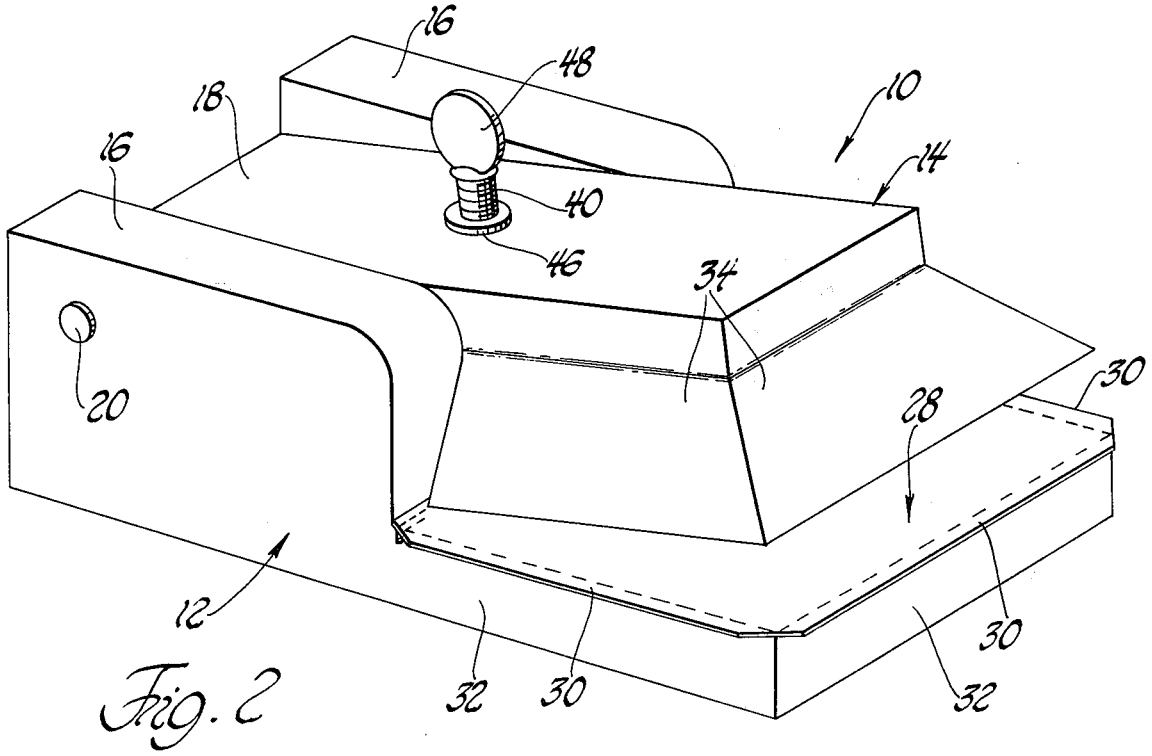
FIG. 2 is a perspective view similar to FIG. 1 but with the clamp member shown in an open position.

Referring to FIG. 1 of the drawings, apparatus constructed according to the present invention and utilized in accordance with the method thereof is indicated collectively by reference numeral 10 and includes a pair of clamp members 12 and 14. Clamp member 12 is a base clamp member including mounting portions 16 that extend upwardly in a spaced relationship to each other. Clamp member 14 is a movable clamp member having a projection 18 received between the mounting portion 16 of the base clamp member. A pin 20 extends between the mounting portion 16 through a hole 22 (FIG. 3) in the movable clamp member projection 18. The movable clamp member 14 is pivotally supported relative to the base clamp member 12 for movement between the closed position of FIG. 1 and the open position of FIG. 2, the closed position being shown by solid line illustration in FIG. 3 and the open position being shown there by phantom line illustration. Clamp members 12 and 14 respectively include planar clamping surfaces 24 and 26 (FIG. 3) that have square shapes when viewed from a direction perpendicular to the surfaces. As the clamp members 12 and 14 are moved to their closed position, the clamping surfaces 24 and 26 move into an opposed relationship with respect to each other to clamp a flattened container can portion 28 therebetween with three edges 30 of the can portion projecting outwardly from between the clamp members.

With the can portion 28 secured in its clamped condition of FIG. 1, each of its edges 30 is aligned with a set of edge surfaces 32 and 34 on the base and movable clamp members 12 and 14, respectively. The edge surfaces 32 of the base clamp member extend from its clamping surface 24 in a perpendicular relationship while the edge surfaces 34 of the movable clamp member extend from its clamping surface 26 in an inclined relationship. A manually held tool 36 of the apparatus has a curved work portion 38 that is used to bend the can portion edges 30 downwardly away from the inclined edge surfaces 34 toward and into engagement with the perpendicular edge surfaces 32 in order to provide reinforcing flanges for the can portion that give it the strength to function as a decorative tile. When an aluminum can portion is being bent, its edges can be pressed against a table surface or the like rather than using the tool 36 since aluminum is much softer than tin coated steel. Bending of the can portion edges 30 can readily be performed in either manner due to the open space above the edges as a result of the inclined orientation of the edge surfaces 34 on the movable clamp member 14.

Figure 3:
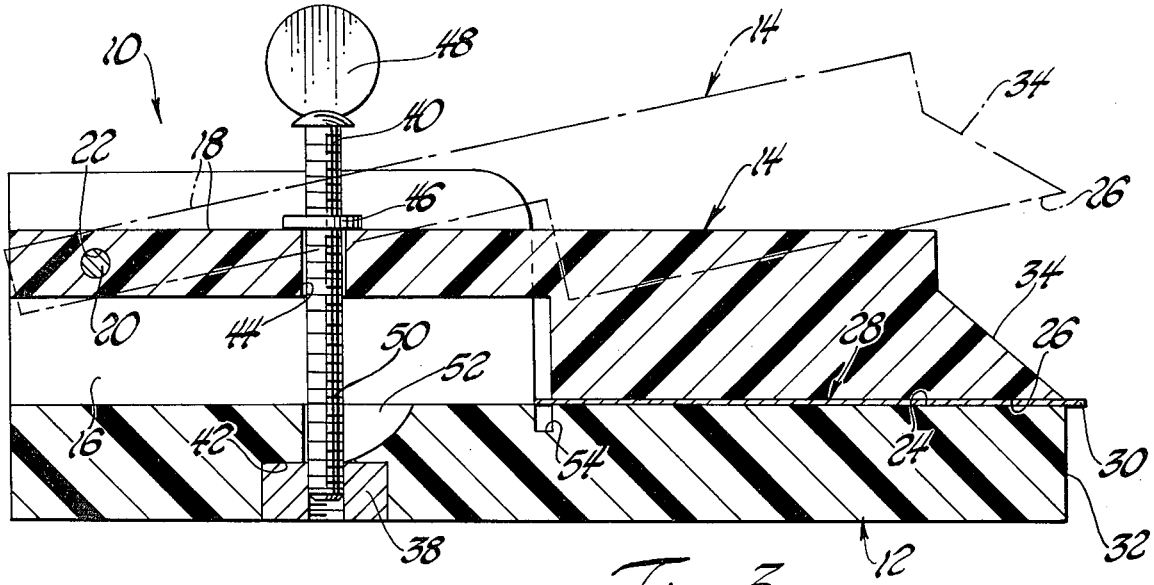
FIG. 3 is a sectional view taken along line 3—3 of FIG. 1 through the closed clamp members and also shows the clamp members in their open position by phantom line illustration.

During the bending of the can portion edges, a nut 38 and a cooperable screw 40 best shown in FIG. 3 are utilized to secure the clamp members 12 and 14 in their closed position clamping the can portion. Nut 38 is mounted in a downwardly facing opening 42 of the base clamp member 12 and is secured thereto by any suitable means in a nonrotatable manner. The screw 40 is mounted on the movable clamp member 14 extending downwardly through a hole 44 in the clamp member projection 18. An annular flange 46 of the screw engages the top side of the clamp member projection 18 and an upper flat 48 allows the screw to be manually grasped and rotated so that its lower end 50 can be threaded into the nut 38. As the movable clamp member 14 is pivoted downwardly to the closed position relative to the base clamp member 12, the lower screw end 50 can move through a slot 52 in the base clamp member in order to readily thread into the nut 38. As the screw 40 is threaded into the nut 38, its flange 46 presses downwardly on the movable clamp member 14 so that its clamping surface 26 cooperates with the clamping surface 24 of the base clamp member to clamp the can portion 28.

Figure 8:
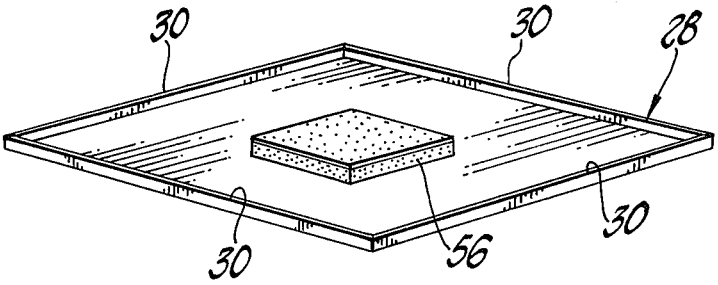
FIG. 8 is a perspective view of the decorative tile from its back side to illustrate reinforcing edge flanges thereof and an attachment member utilized in mounting the tile.

With the movable clamp member 14 held in its closed position relative to the base clamp member 12, three edges 30 of can portion 28 can be bent to form reinforcing flanges without unclamping of the can portion. After these three flanges have been bent, the screw 40 is unthreaded from nut 38 to allow the movable clamp member 14 to pivot upwardly to its open position so that the partially finished tile can be repositioned and clamped with its remaining unbent edge 30 extending outwardly from between the clamp members in alignment with one of the sets of edge surfaces 32 and 34. In this clamped condition, one of the bent reinforcing flanges of the can portion will be located within a groove 54 (FIG. 3) in the base clamp member 12 between its mounting portions 16 and its clamping surface 24. Bending of the remaining flange in the same manner previously described, then produces a decorative tile having four reinforced edge flanges provided by its edges 30 as shown in FIG. 8. A foam attachment member 56 with adhesive on each of its sides is then applied to the completed tile so that it can be mounted in a suitable manner as desired. Likewise, glue and other suitable attachment methods may be used to mount the tile.

Figure 4:
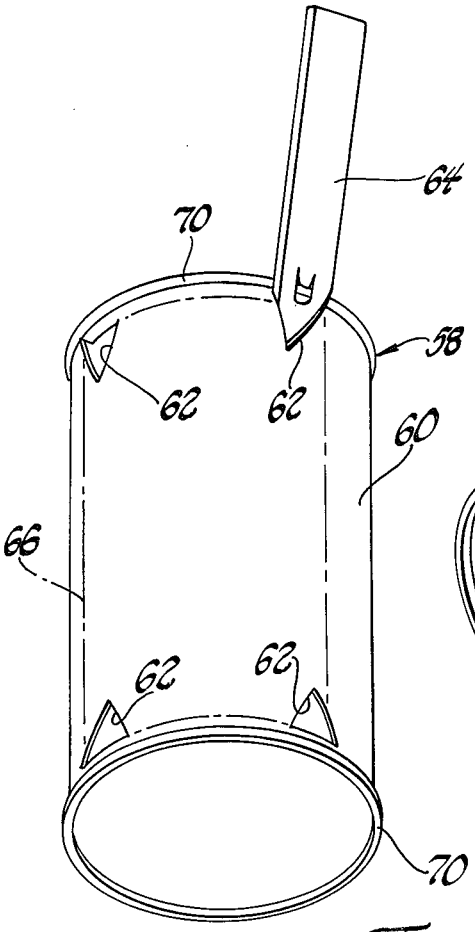
FIGS. 4, 5 and 6 illustrate the manner in which a flattened can portion can be prepared from a container can.
Figure 5:
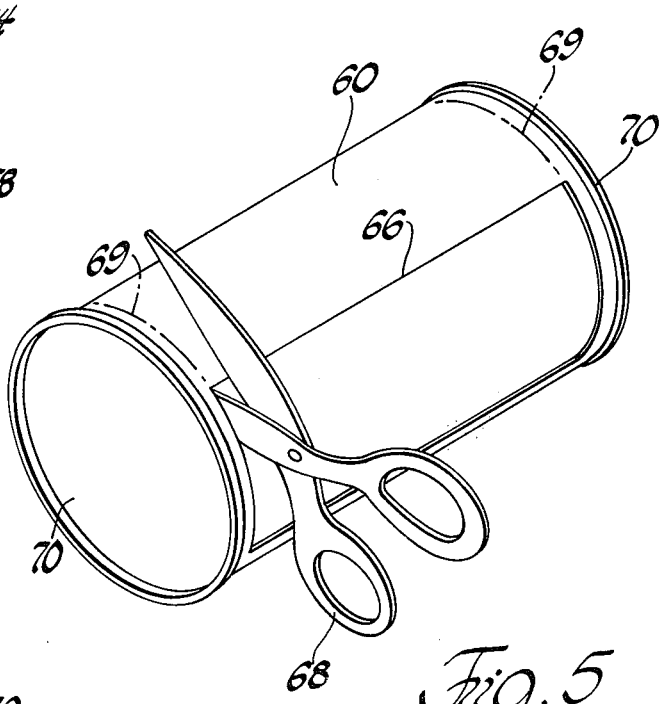
Figure 6:
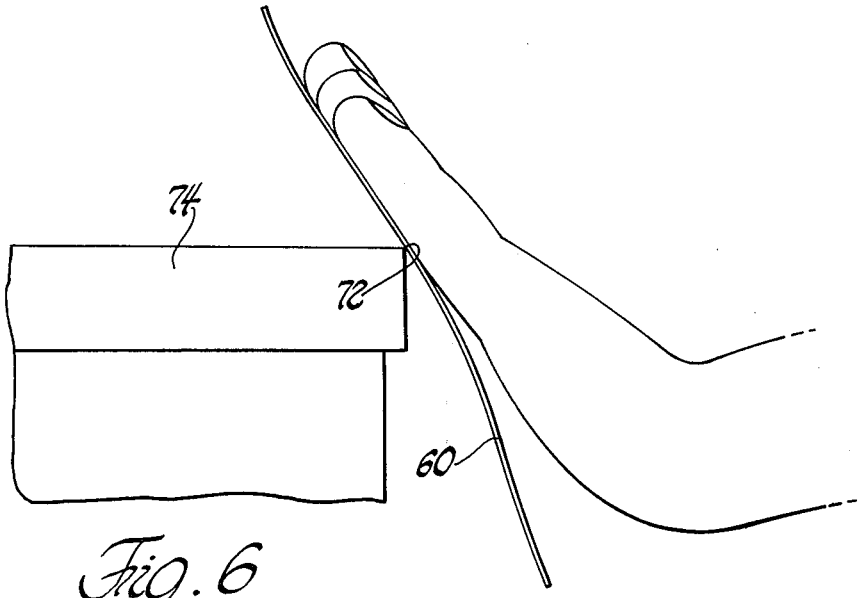

The flattened can portion used to fabricate the decorative tile can be manufactured in the manner shown by FIGS. 4–6. As seen in FIG. 4, a container can indicated by 58 has its cylindrical portion 60 formed with four openings 62 by a can opener 64. Openings 62 are formed in the cylindrical portion 60 on the opposite side thereof from a decorative printed portion that is to become part of the face of the completed decorative tile being fabricated. A rectangle 66 shown by phantom lines is then cut by tin snips or scissors from the can portion so that the can then has the configuration generally as shown in FIG. 5. The tin snips or scissors 68 shown in FIG. 5 is then used to cut the cylindrical can portion 60 along phantom lines 69 so that the can ends 70 can be removed. Subsequently, as shown in FIG. 6, the cylindrical can portion 60 is rubbed over the edge 72 of a table 74 or the like in order to flatten the can portion.

Figure 7:
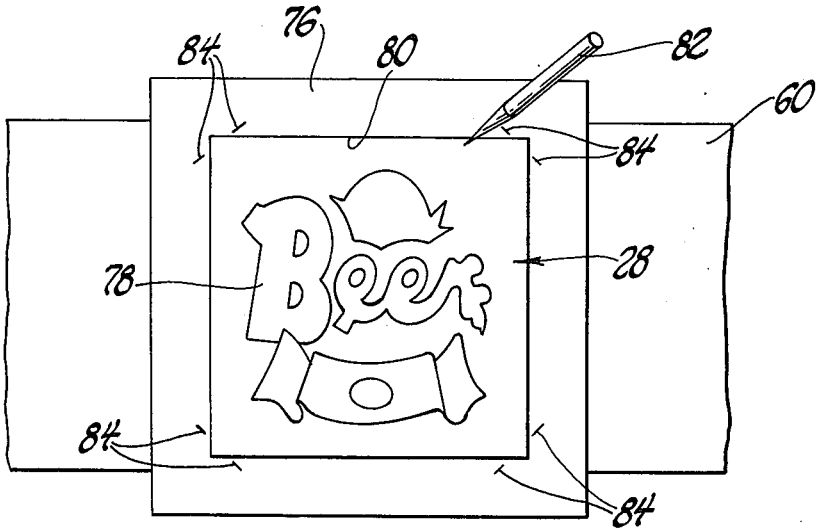
FIG. 7 illustrates a template utilized to cut the flattened can portion to the proper size in order to fabricate the decorative tile.

After flattening of the can portion as described above, a template 76 shown in FIG. 7 is utilized to cut the can portion 28 to proper size with its decorative markings 78 centered or otherwise located in an aesthetically appealing fashion. A central opening 80 of a square shape in the template allows a pencil 82 or other suitable marking instrument to be used to draw the outline of can portion 28. Corner markings 84 of the template are used to scribe lines for cutting the corners off of can portion 28. Consequently, as shown in FIG. 1, the can portion edges 30 do not project outwardly from between the clamp members 12 and 14 at the straight line junctions of their edge surfaces 32 and 34. There is no excess material at the corners of the can portion 28 that can interfere with its bending due to the manner in which its corners are cut off with the aid of markings 84 shown in FIG. 7 on the template 76. It has been found preferable to have these markings 84 provided rather than having the opening 80 formed with angular corners that would be aligned with the markings. The reason for this is that proper alignment and centering of the decorative can markings 78 can best be provided when the eye has a right angle corner to align the template in the proper position.

It should be noted that with certain container cans, such as certain beer cans, the cylindrical can portion is printed on its opposite sides with a pair of decorative markings so that two decorative tiles could be formed from a single can rather than only one in the manner described in connection with FIGS. 4–7. However, this requires a suitable tool or instrument for cutting off the can ends 70 shown in FIG. 5 along phantom lines 69 without first cutting out the rectangular opening. After flattening, both of the decorative markings on the flattened can portion can be utilized to form a decorative tile in the same manner as previously described.

While a preferred apparatus and method for practicing the present invention has herein been described in detail, those skilled in the art will recognize various alternative embodiments and methods for carrying out the invention as defined by the following claims.

What is claimed is:

1. Apparatus for use in fabricating decorative tiles from container cans comprising: a pair of clamp members having generally rectangular clamping surfaces; means mounting the clamp members for movement between an open position where the clamping surfaces are spaced from each other and a closed position where the clamping surfaces oppose each other to clamp a flattened can portion of a generally rectangular shape therebetween with three edges thereof projecting outwardly from between the clamp members; one of the clamp members having three edge surfaces extending generally perpendicular to the clamping surface thereof adjacent the outwardly projecting can edges; and the other clamp member having three edge surfaces that extend inwardly with respect to the associated perpendicular edge surfaces thereof adjacent the outwardly projecting can edges, the inwardly extending edge surfaces enabling the can portion edges to be readily bent into engagement with the perpendicular edge surfaces without unclamping thereof to thereby provide a tile with reinforcing edge flanges.

2. Apparatus as claimed n claim 1 wherein the clamp member with the perpendicular edge surfaces is a base clamp member having upwardly projecting mounting portions spaced from each other, the clamp member with the inwardly extending edge surfaces having a projection received between the mounting portions, the mounting means including a pin that pivotally supports the projection between the mounting portions, and means for securing the clamp members in the closed position.

3. Apparatus as claimed in claim 2 wherein the securing means includes a nut mounted on the base clamp member and a screw mounted on the other clamp member and having an end that threadedly engages the nut, and the base clamp member having a slot through which the screw end can pass as the clamp members move to the closed position.

4. Apparatus as claimed in claim 1 further including a template having a square opening used in cutting the can portion.

5. Apparatus as claimed in claim 4 wherein the template includes corner markings for use in cutting off corners of the can portion.

6. Apparatus as claimed in claim 4 further including a manual tool having a curved work portion for bending the can portion edge.

7. A method for fabricating decorative tiles from container cans comprising: positioning a flattened can portion of a generally rectangular shape between rectangular clamping surfaces of two clamp members having respective sets of three edge surfaces one set of which is perpendicular to the associated clamping surface and the other set of which extends inwardly with respect to the perpendicular edge surfaces; moving the clamp members to a closed position to clamp the can portion between the clamping surfaces thereof with three edges of the can portion projecting outwardly from between the edge surfaces of the clamp members; and bending the three outwardly projecting can portion edges away from the inwardly extending edge surfaces toward the perpendicular edge surfaces to provide reinforcing edge flanges.

8. A method according to claim 7 and further including the step of applying an attachment method to the can portion on the surface thereof toward which the edges are bent.

* * * * *

UNITED STATES PATENT OFFICE

CERTIFICATE OF CORRECTION

Patent No. 4,046,090 Dated September 6, 1977

Inventor(s) Thomas A Capeling and Robert G. Lovins

It is certified that error appears in the above-identified patent and that said Letters Patent are hereby corrected as shown below:

Column 1, line 18 "ans" should be --cans--.

Column 1, line 49 after "carrying" insert --out--.

Column 6, line 4 after claimed "n" should be --in--.

Column 6, line 48 "method" should be --member--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*